US006039094A

United States Patent [19]

Neville

[11] Patent Number: 6,039,094

[45] Date of Patent: Mar. 21, 2000

[54] LOG TURNING MACHINE GUIDES

[75] Inventor: Richard L. Neville, Victor, Mont.

[73] Assignee: Nevilog, Inc., Victor, Mont.

[21] Appl. No.: 09/310,379

[22] Filed: May 12, 1999

[51] Int. Cl.[7] ..... B27C 7/00; B27B 31/00

[52] U.S. Cl. ..... 144/4; 144/2.1; 144/242.1; 144/246.1; 144/253.1; 144/363

[58] Field of Search ..... 144/2.1, 4, 3.1, 144/242.1, 246.1, 253.1, 208.1, 208.8, 340, 341, 363

[56] References Cited

U.S. PATENT DOCUMENTS

| | | | |
|---|---|---|---|
| 1,669,716 | 5/1928 | Lane . | |
| 3,527,336 | 9/1970 | Johnston | 198/137 |
| 3,874,497 | 4/1975 | Carlson | 198/204 |
| 4,303,111 | 12/1981 | Neville | 144/4 |
| 4,519,429 | 5/1985 | Dreese | 144/3.1 |
| 4,724,877 | 2/1988 | Culley, Jr. | 144/116 |

*Primary Examiner*—W. Donald Bray
*Attorney, Agent, or Firm*—Wells, St. John, Roberts, Gregory & Matkins, P.S.

[57] ABSTRACT

A log turning machine is described in which a support frame mounts a rotary cutter with a log receiving opening positioned to receive an elongated log workpiece that is moved relative to the support frame in a forward direction of travel along an axis. The rotary cutter is operable to cut the log workpiece to a prescribed diameter centered on the axis. A set of elongated guide members having opposed first and second ends are mounted to the support frame by sets of links for adjustable movement substantially radially with respect to the axis between a minimum and a maximum cutting diameter. The first ends of the guide members are positioned downstream of and adjacent the rotary cutter and extend substantially parallel to the axis by a distance that is a multiple of the maximum cutting diameter. Guide member positioners operatively connect at least some of the guide members and support frame to enable selective adjustment of the guide members substantially radially between the minimum and maximum diameter. A cutter head and support frame adjuster may also be provided to enable positioning of the cutter head and axis for adjustment of the cutting diameter relative to a log infeed plane.

21 Claims, 6 Drawing Sheets

LOG TURNING MACHINE GUIDES

TECHNICAL FIELD

The present invention relates to turning logs to specific diameters and to guides in machines for turning logs.

BACKGROUND OF THE INVENTION

Log home construction is significantly eased by providing logs of constant diameter along the log length. Logs of all species include a taper from a maximum diameter at the trunk or butt ends to a minimum diameter at the crown or top ends. Those building log homes from tapered logs must take care to alternate the tapers. Notches at corners must also be varied to accommodate different diameters of the intersecting logs. This significantly extends the amount of labor and time required to complete the construction. To further exacerbate the problem, the degree of taper may vary substantially from one log to the next. Each log in a construction project must therefor be carefully selected not only for length and diameter, but also for the degree of taper.

Various log turning machines have been developed in the past to solve the various problems presented by tapered logs. One form of turning machine is basically a very large lathe. The log is driven to rotate and a cutter is moved along to cut the log length to a desired diameter. This requires an extremely large machine, especially for long logs. Feeding and discharge of successive logs to such machines also becomes a time consuming and difficult problem. A finished log must be disengaged and removed from the machine, and a new log must be positioned and engaged by the machine before the next turning operation can take place.

An innovative solution to the problems presented by conventional lathe machines involves passing successive logs lengthwise through a rotary cutter head. The time consuming steps of feeding, discharging and set-up of the machine may be nearly eliminated by feeding successive logs in end-to-end relation through the rotary cutter head. The logs are cut to a constant diameter as they are fed through the machine.

Rotary cutter head machines were a marked advancement in reducing the overall costs and equipment required for turning logs, but such machines were not without difficulties. Firstly, a log moving through a rotary cutter head must be well supported along its length during the cutting operation or the finished log may not be straight. This is accomplished by the infeed conveying mechanism upstream of the cutter head.

Since the infeed conveyor cannot pass through the cutter head (due to the rotating cutters), a separate support mechanism must be provided downstream of the cutter head. This support mechanism must be accurately positioned to guide the cut part of the log along through the finish of the cut. Lateral shifting of the cut part of the log downstream of the cutter head will result in the cutter head gouging the log, or an unacceptable crook or bend may be cut into that part of the log which is presently moving through the cutter head.

The present inventor has experimented in the past with different forms of guides that have operated with only minimal success in preventing logs from shifting as they pass through a rotating cutter head. It was not until advent of the present guide arrangement and cutter head that high numbers of logs could be turned accurately and straight.

It is therefor a first objective of the present invention to provide a log guide and cutting arrangement that will reliably form logs with a circular cross sectional shape along a straight central axis.

A still further objective is to provide such an arrangement that is adjustable to form logs of different finished log diameters.

The above and still further objectives and advantages may become apparent from the drawings and description provided below and in which the best mode presently known is disclosed for carrying out the present invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A log guide assembly 11 is provided in one preferred embodiment of the present invention in a combination including a turning machine 10 for holding a log 12 in a prescribed orientation relative to an axis "A" as the log is fed through the turning machine. The objective for the guide assembly 11 is to hold successive logs in the prescribed orientation during the cutting operation so the finished log will be straight and circular along its full length.

Figure 5:
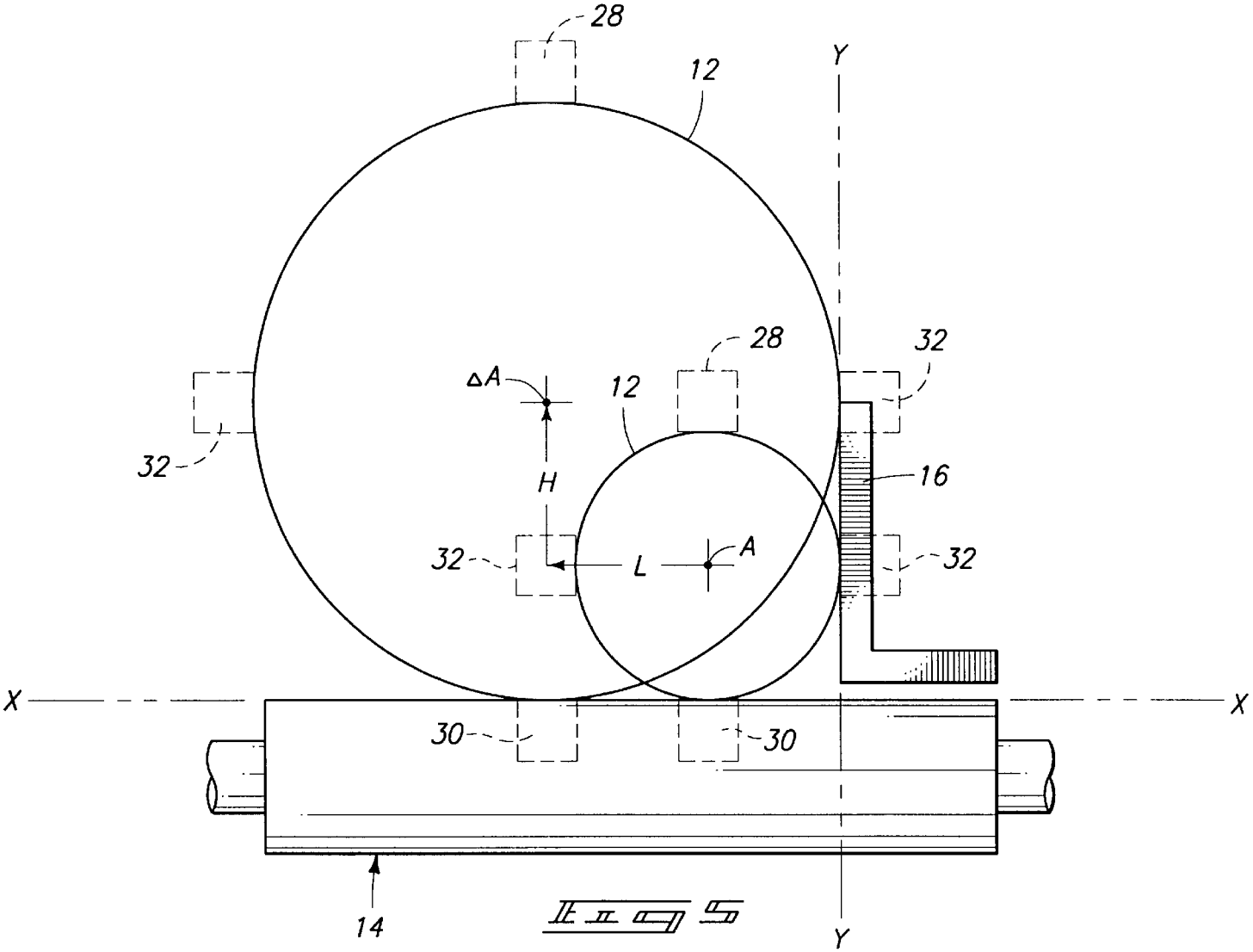
FIG. 5 is a schematic view illustrating adjustability to accommodate and form logs of various selected diameters.

In other preferred embodiments, the turning machine 10 may include a log conveyor 14 powered to deliver successive logs 12 lengthwise in a forward direction of travel and along a defined log infeed plane "x" (FIG. 5). A fence 16, adjacent the log conveyor 14 may be configured to tangentially engage and guide the elongated log lengthwise along an upright plane "y" intersecting the log infeed plane "x." The successive logs may thus be positioned in a determined spatial orientation as they are delivered lengthwise and in end-to-end relation into the rotary cutter head 18.

The cutter head 18 includes a series of cutting blades 22 (FIG. 1) that are radially adjustable with respect to the central axis "A". The blades are powered to rotate about the axis "A" as successive logs are moved through the cutter head and cut the logs to a selected finished consistent diameter.

Typically, the conveyor 14 will not be adjustable laterally or elevationally. Thus the infeed plane "x" (FIG. 5) and upright plane "y" may be fixed by the conveyor height and the lateral position of the fence 16. FIG. 5 also shows the resulting positions of two logs having different diameters (shown in dashed lines).

It is noted that both logs are in tangential contact with and rest against the infeed conveyor 14 and the fence 16. It is also noted for further reference below, that the centers of the two logs are in different lateral and elevational positions. The log centers are shown in FIG. 5 coincidentally with the axis "A" and a shifted axis "ΔA".

Log delivery conveyor 14, and rotary cutter head 18 may be selected from similar apparatus that is known in the log turning industry and thus need not be described in detail herein. For example, U.S. Pat. No. 4,303,111 to the present Applicant, Richard L. Neville; or U.S. Pat. No. 4,519,429 to Dreese are exemplary of feed conveyors, annular frames mounting annular rotated cutter mounting parts. Portions of these patents related to feed conveyors and rotary cutter heads are hereby incorporated by reference in the present application. Further, the incorporated Neville patent also shows a feed mechanism used for supporting and delivering successive workpieces through a cutter.

Figure 1:
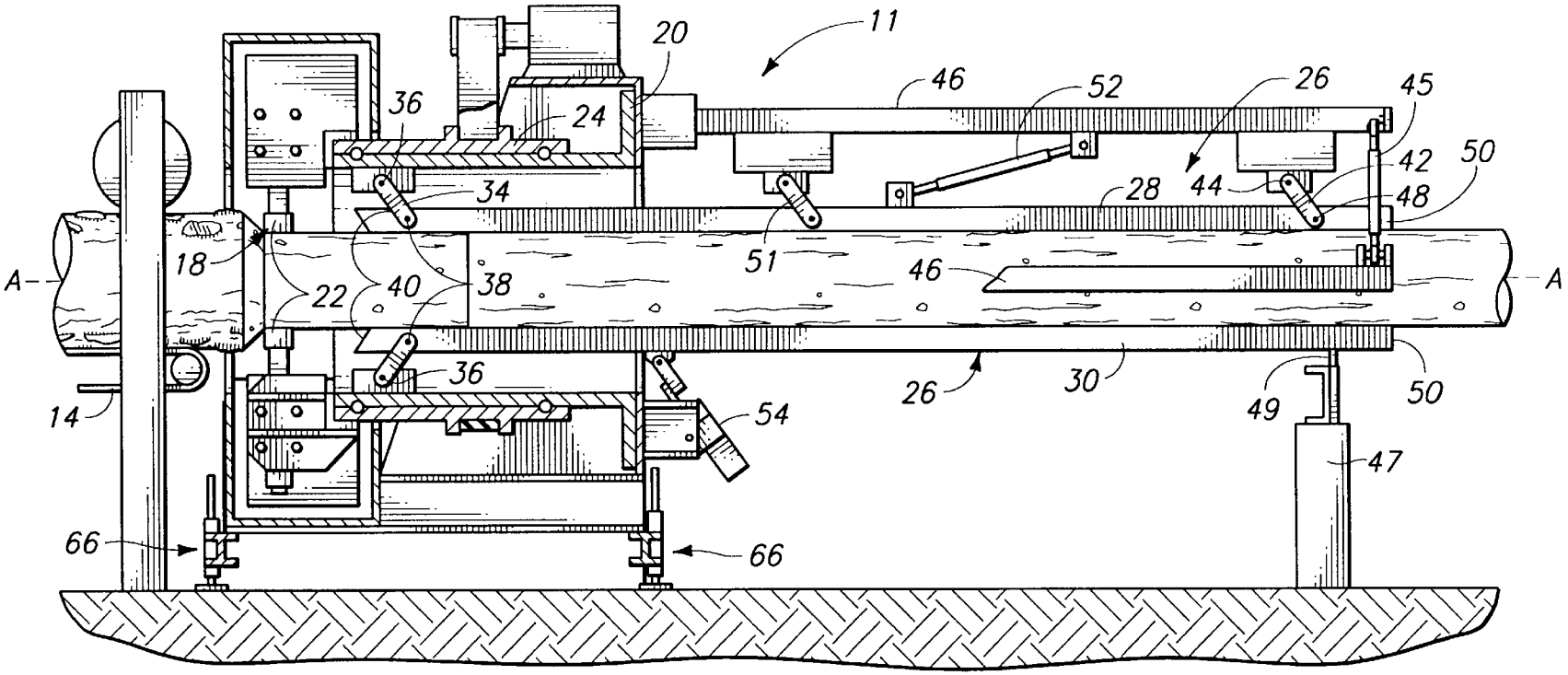
FIG. 1 is a partially sectioned elevational view through a cutting head and guide arrangement that includes features of a first preferred form of the present invention.
Figure 2:
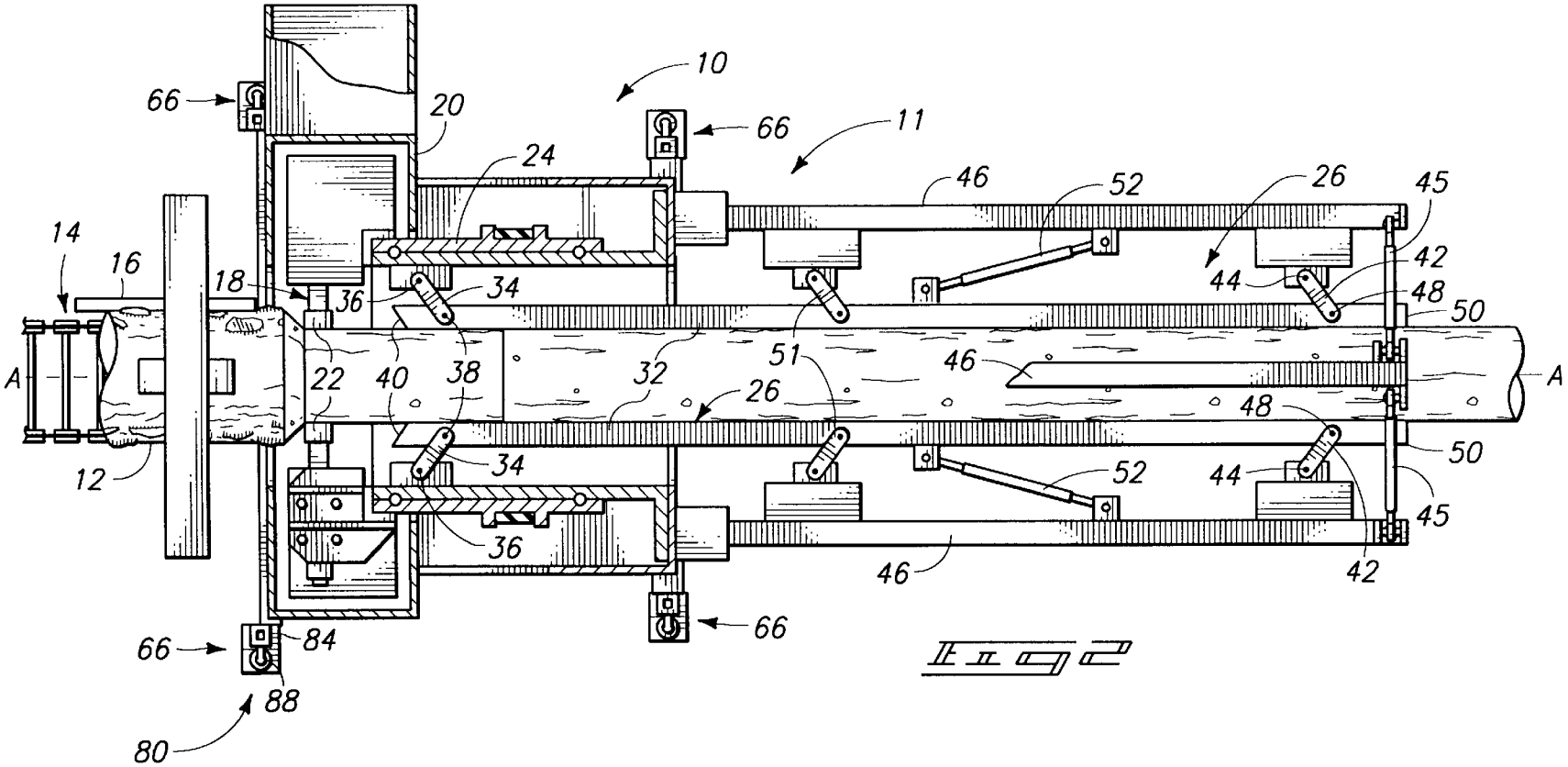
FIG. 2 is a partially sectioned top plan view through the same cutting head and guide arrangement.

In the preferred form shown in FIGS. 1 and 2, a support frame 20 operatively mounts a set of elongated guide members 26. The preferred guide member set 26 includes top and bottom guide members 28, 30, and opposed side guide members 32, all preferably equi-angularly spaced about the axis "A".

Each of the guide members includes opposed first and second ends 40, 50. The first guide member ends 40 are positioned downstream of and adjacent to the rotary cutter head 18, and the second ends 50 are situated downstream of the first ends 40.

The distance in preferred forms between the first and second guide member ends 40, 50 is a factor (a multiple) of the maximum finished diameter of logs shaped by the rotary cutter head 18.

I have found that a most preferable length for the guide members 26 is more than 5 and less than approximately 8 times the maximum cutting diameter. Most preferably, a guide member length is about 7.3 times the maximum cutting diameter capability of the rotary cutter head. Thus, a maximum cut diameter of, say, 18 inches will determine a guide member length of about 11 feet. Shorter guide members provide less stability for the logs (especially heavy large 11 diameter logs) emerging from the rotary cutter head. Substantially longer guide members may function but are bulky and difficult to adjust in proper parallel relation to the axis "A".

The guide members 26 may all be of similar construction, formed of straight relatively rigid bars having log engaging surfaces facing the axis "A." The inwardly facing surfaces may be covered with a low friction material such as high or ultra high density polyethylene to promote sliding engagement with successive logs fed through the rotary cutting head.

A first set of links 34 mount the guide members 26 adjacent their first ends 40 to the support frame for adjustable movement substantially radially with respect to the axis between a minimum and a maximum diameter. Pivot pins 36 join the links 34 to the fixed inside ring of the cutter head 20, and similar, parallel pivot pins 38 mount the respective links to the guide members 26. The pivot pins permit swinging motion of the attached guide members substantially radially with respect to the axis "A".

Figure 3:
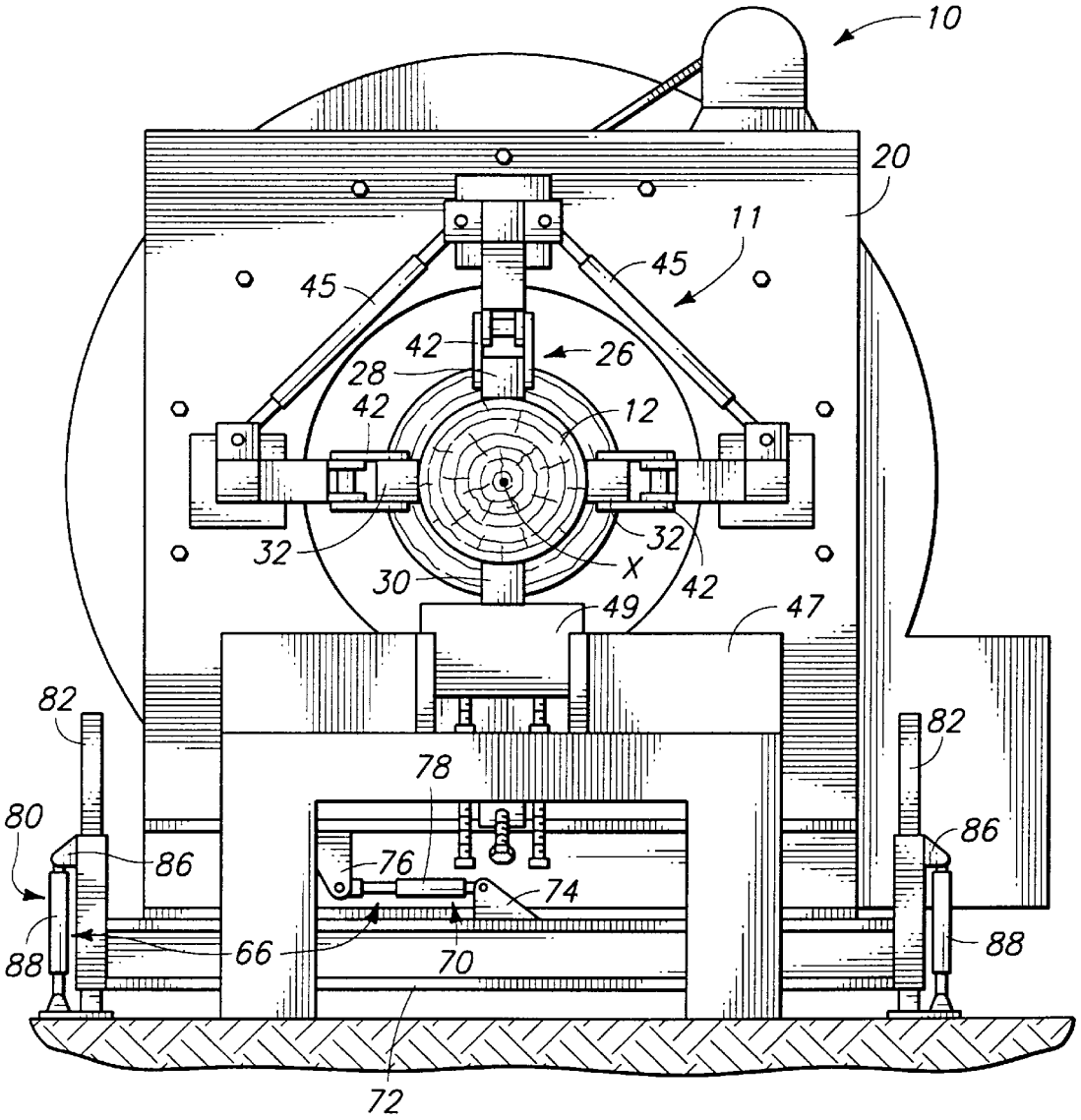
FIG. 3 is an enlarged downstream end view of the preferred cutting head and guide arrangement.

A second set of links 42 mount selected guide members 26 to the support frame. Most preferably, the support frame 20 includes rigid frame extension bars 46 that extend downstream from the cutter head area for the purpose of mounting the second set of links 42 and the second ends 50 of the associated guide members 26. The frame extensions 46 are preferably cantilevered from a cutter head housing part of the support frame 20, substantially as shown in FIGS. 1 and 2. The free ends of the extensions 46 are advantageously tied to one another by adjustable transverse struts (FIGS. 2, 3) that may be provided in the form of turnbuckles 45 that will facilitate accurate adjustment of the side guide members 32 in relation to one another and to the top guide member 28.

The links 42 are mounted by pivot pins 44 to the respective frame extensions 46, and by pivot pins 48 to the selected guide members 26. The links 42 and 34 are substantially parallel on the respective guide members, forming a parallelogram linkage to maintain the selected guide members 26 parallel to the axis "A".

It is preferable that the first and second link sets 34, 42 connect the top guide member 28 and the opposed side guide members 32 to respective top and opposed side frame extensions. The bottom guide member 30 is connected at its front end 40 to the support frame as are the top and side guide members 28, 32; by a link 34. The rearward end of guide member 30, however, may be supported on a floor mounted stand 47 (FIGS. 1, 3) and rests against a height adjustable plate 49 which is used to set the elevation. The bottom guide member 30 is preferably slidable laterally over the top of the height adjustable plate 49.

An intermediate set of links 51 are preferably connected between at least some of the guide members 26 and support frame between the first and second sets of links. Most preferably, these links 51 are similar to the first and second sets of links and connect the top and if opposed side guide members to respective frame extensions 46 as shown in FIGS. 1 and 2. The intermediate links 51 are substantially parallel to the links 34 and 42, maintaining the parallelogram linkage geometry. They will thus permit adjustment of the selected guide members with respect to the axis "A", but will also function to prevent the engaged guide members from bowing radially in or outwardly.

Radial adjustment (with respect to axis "A") of selected guide members (preferably the top and opposed side guide members 28, 32) may be effected by guide member positioners, such as conventional screw-type turnbuckles 52. The preferred turnbuckles are mounted between the selected guide members and respective frame extensions 46 (FIGS. 1 and 2).

It is preferable that the turnbuckles 52 be mounted at acute angles to the respective top guide member 28 and side guide members 32, opposite the angles of the links 34, 42, and 51. Extension and retraction of the turnbuckles will result in swinging movement of the top and side guide members toward and away from the axis "A", radially adjusting the selected guide members between minimum and maximum diameters with respect to the axis "A".

Figure 4:
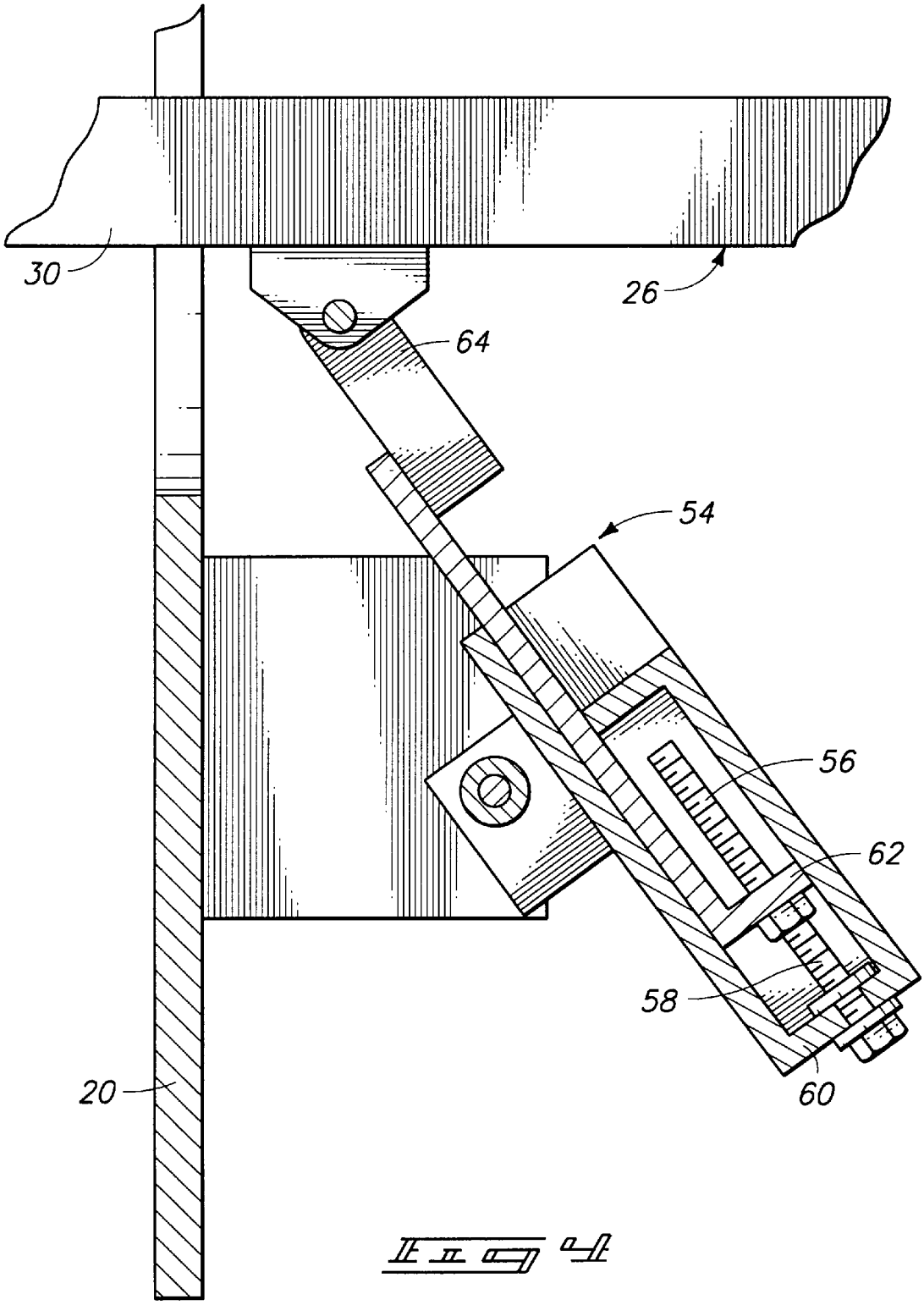
FIG. 4 is a fragmented and enlarged sectional view of an adjustable link.

The bottom guide member 30 may be adjusted by an adjustable link 54 (FIGS. 1 and 4) mounted between the bottom guide member 30 and the support frame 20. A preferred adjustable link 54 includes a link length adjustment 56 that is shown in detail by FIG. 4. As exemplified, an axially captured bolt 58 is mounted to a base part 60 that is pivotably mounted to the support frame 20. The bolt is rotatable and threadably engages a bracket 62 that is slidably carried by the base part 60. The bracket 62 is elongated and extends angularly upwardly to a pivot mount 64 that is secured to the bottom guide member 30. Rotation of the bolt 58 will thus result in elevational movement of the bottom guide member 30 and the link 36 at the forward end of member 30 (FIG. 1) will pivot accordingly.

Figure 6:
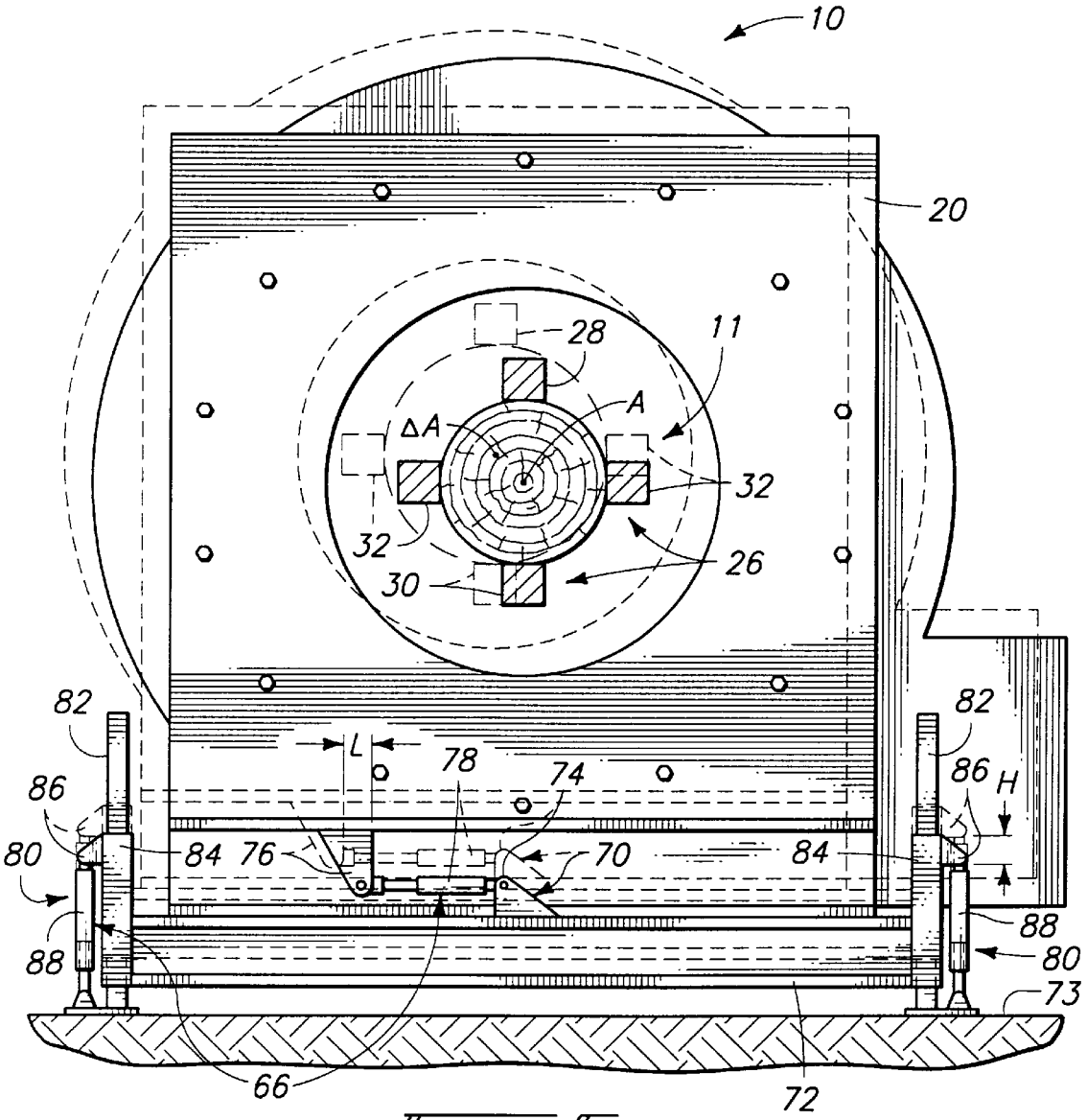
FIG. 6 is an end view similar to FIG. 3 further illustrating the adjustment capabilities of the cutter head and resulting positions of the guide members.

It is noted that the set of guide members 26 and their respective adjustment mechanisms are all mounted to the support frame 20 which also mounts the cutter head 18. These elements may thus be adjustably positioned as determined by a cutter head and support frame adjuster 66, an example of which is illustrated by FIG. 6.

The adjuster 66 is selectively operable to shift the cutter head, support frame, and guide members: (A) laterally relative to the fence 16 (and upright plane "y"; and (B) elevationally relative to the infeed plane "x." This is done to shift the axis "A" and enable selective adjustment of the cutting diameter without requiring adjustment of the feed conveyor height or lateral position of the fence 16.

In preferred forms, the cutter head and support frame adjuster 66 includes a lateral adjuster 70 (FIG. 6) that is selectively extendible and retractable and is mounted between a base frame 72 and support frame 20. In a specific embodiment, the lateral adjuster 70 is comprised of a hydraulic cylinder 78 that is mounted between a bracket 74 on the base frame 72 and a similar bracket 76 on the support frame 20. The support frame is configured to slide laterally (in a plane parallel to the infeed plane "x") on the base frame 72, so extension and retraction of the cylinder 78 will cause the support frame 20 and elements mounted thereto, to shift laterally.

FIG. 5 graphically identifies an exemplary lateral adjustment distance L effected by selective extension of the adjuster 70. The same lateral adjustment distance is illustrated in FIG. 6.

Preferred forms of the cutter head and support frame adjuster 70 also include a lift 80 that is operably mounted between the support frame 20 and primary support surface 73. More specifically, the preferred lift is connected between the base frame 72 and the support surface 73. The lift 80 is selectively extendible and retractable such that extension and retraction of the lift will cause the support frame 20 to move elevationally along the upright plane "y".

By way of example, the lift 80 may include a set of upright posts 82 that are positioned about the cutter head and that are affixed to the primary support surface 73. Guide sleeves 84 are affixed to the base frame 72 and slidably engage the respective posts 84. A bracket 86 on each guide sleeve 84 mounts one end of a ram cylinder or other appropriate lift jack 88, the opposite end of which is anchored to the primary support surface 73. Uniform operation of the lift jacks 88 will result in elevational movement of the base frame 72, the support frame 20 and elements attached thereto.

FIG. 5 graphically identifies an exemplary elevational adjustment distance H effected by selective extension of the lift 80. The same lateral adjustment distance is illustrated in FIG. 6.

Selective operation of the lateral adjuster 70 and the lift 80 will effectively shift the axis A to a desired location (AA) relative to the log infeed plane "x" and upright plane "y". Such adjustment will change the effective rotational axis of the cutters and enable radial adjustment of the cutters 18 to cut logs to a different finished diameter.

Since the guide members 26 are mounted to the support frame 20, selective positioning of the support frame will also result in similar positioning of the guide members. However, the guide members will require further adjustment to accommodate a change in the cutting diameter. This is accomplished by selective adjustment of appropriate turnbuckles 52.

An exemplary adjustment of the guide members after a lateral and elevational shift of the cutter head (by distances L and H) may be explained with reference to the FIG. 5. Here the guide members are shown in two positions identified by dashed lines: a first position in which the guide members are shown slidably engaging a log cut to a small diameter, centered on axis "A"; and a second position in which the guide members are shown slidably engaging a log cut to a large diameter centered on the shifted axis "ΔA".

It is noted that the right side guide member 32 (as viewed in FIG. 5) must be adjusted laterally outward by the distance L by operation of an associated turnbuckle, so its log engaging surface will remain precisely in the plane "y" as defined by the fence 16. The opposite, left side guide member is then adjusted so its log engaging surface is spaced from the right guide member by the larger log diameter.

It is also noted that the bottom guide member 30 must be adjusted so its log engaging surface will remain precisely in the infeed plane "x". This is done by appropriately adjusting the adjustable link 54 (FIGS. 1, 4) to drop the guide member 30 the distance H back onto the height adjustable plate 49 (which may remain in its original position). The top guide member 28 is then adjusted so its log engaging surface is spaced from the bottom guide member by the larger log diameter.

The guide members are now re-adjusted to the different larger log diameter and are ready for operation. Additional "fine tuning" of the adjusted guide member positions may take place once a log is fed through the cutter head and is cut to the desired finished diameter. In doing so, the log engaging surfaces are positioned against the surface of the log to hold the finished part of the log coaxial with the shifted axis "ΔA". The finished part of the advancing log is allowed to slide along the guide members but is not allowed to shift laterally. The result is a finished circular log that is straight along its full length.

In compliance with the statute, the invention has been described in language more or less specific as to structural and methodical features. It is to be understood, however, that the invention is not limited to the specific features shown and described, since the means wherein disclosed comprise preferred forms of putting the invention into effect. The invention is, therefore, claimed in any of its forms or modifications within the proper scope of the appended claims appropriately interpreted in accordance with the doctrine of equivalents.

I claim:

1. In a log turning machine including a cutter head for cutting a log workpiece to a specified diameter about an axis, a log guide comprising:

a support frame;

a set of elongated guide members having opposed first and second ends;

a first set of links mounting the guide members adjacent the first ends thereof to the support frame for adjustable movement substantially radially with respect to the axis between a minimum and a maximum diameter;

a second set of links mounting selected guide members to the support frame adjacent the second ends thereof for adjustable movement substantially radially with respect to the axis; and wherein the second ends are spaced along the axis from the first ends by a distance at least 5 times the maximum diameter.

2. The log stabilizing device of claim 1 wherein the guide members are substantially equi-angularly spaced about the axis.

3. The log stabilizing device of claim 1 wherein the first and second set of links are substantially parallel to one another along respective guide members.

4. The log stabilizing device of claim 1, wherein the guide members are substantially equi-angularly spaced about the axis and include top and bottom guide members, and an opposed side guide members.

5. The log stabilizing device of claim 1 further comprising guide member positioners mounted between selected guide members and the support frame, configured to enable substantially radial adjustment of the selected guide members between the minimum and maximum diameters with respect to the axis.

6. The log stabilizing device of claim 1 further comprising guide member positioners mounted between selected guide members and the support frame, the guide member positioners being comprised of turnbuckles.

7. The log stabilizing device of claim 1 further comprising an intermediate set of links connected between at least some of the guide members and support frame and positioned between the first and second sets of links.

8. The log stabilizing device of claim 1 further comprising an intermediate set of links positioned between the first and second sets of links and connected between selected guide members and support frame; and wherein the first, second and intermediate sets of links are substantially parallel.

9. The log stabilizing device of claim 1 wherein the first and second sets of links are pivotably mounted to support frame and selected guide members to permit substantially radial adjustment of the selected guide members toward and away from the axis.

10. The log stabilizing device of claim 1 wherein the guide members are angularly spaced about the axis and include top and bottom guide members, and an opposed side guide members; and an adjustable link mounted between the bottom guide member and the support frame and wherein the adjustable link includes a link length adjustment; and further comprising an intermediate set of links positioned between the first and second sets of links on the top guide member and side guide members and connected between the top guide member and side guide members and the support frame.

11. A log turning machine, comprising a support frame;

a rotary cutter mounted to the support frame with a log receiving opening for receiving an elongated log workpiece moving relative to the support frame in a forward direction of travel along an axis;

the rotary cutter being operable to cut the log workpiece to a prescribed diameter centered on the axis;

a set of elongated guide members having opposed first and second ends;

a first set of links mounting the guide members adjacent the first ends thereof to the support frame for adjustable movement substantially radially with respect to the axis between a minimum and a maximum diameter and with the first ends projecting axially into the log receiving opening;

a second set of links mounting the guide members to the support frame adjacent the second ends thereof for adjustable movement substantially radially with respect to the axis and with the second ends spaced along the axis from the cutter head by a distance no less than 5 times and no more than approximately 8 times the maximum diameter; and guide member positioners operatively connecting at least some of the guide members and support frame, configured to enable selective adjustment of the guide members substantially radially between the minimum and maximum diameter.

12. A log turning machine as claimed by claim 11, wherein the guide member positioners are comprised of turnbuckles.

13. A log turning machine as claimed by claim 11, wherein the guide members include a top guide member, opposed side guide members, and a bottom guide member and wherein the first and second sets of links are pivotably mounted to the top guide member and side guide members.

14. A log turning machine as claimed by claim 11, wherein the guide members include a top guide member, opposed side guide members, and a bottom guide member spaced angularly about the axis;

the first and second sets of links are pivotably mounted to the top guide member and the side guide members; and the guide member positioners are comprised of turnbuckles mounted at acute angles to the respective top guide member and side guide members between the top guide member and side guide members and the support frame, such that extension and retraction of the turnbuckles will result in swinging movement of the top and side guide members toward and away from the axis.

15. A log turning machine as claimed by claim 11, wherein the support frame includes rigid frame extension bars extending along and spaced radially from the axis;

wherein the guide members include a top guide member, opposed side guide members, and a bottom guide member; and wherein the second set of links pivotably mount the top guide member and side guide members to the rigid frame extension bars.

16. A log turning machine, comprising:

a log conveyor defining a log infeed plane, configured to deliver an elongated log lengthwise along the log infeed plane;

a fence adjacent the log conveyor configured to tangentially engage and guide the elongated log lengthwise along an upright plane intersecting the log infeed plane a support frame;

a cutter head on the support frame including a log receiving opening and having internal cutters configured to cut the elongated log to a prescribed diameter about an axis;

a set of elongated guide members having opposed first and second ends;

a first set of links mounting the guide members adjacent the first ends thereof to the support frame for adjustable movement substantially radially with respect to the axis between a minimum and a maximum diameter and with the first ends adjacent the log receiving opening;

a second set of links mounting selected guide members to the support frame adjacent the second ends thereof for adjustable movement substantially radially with respect to the axis; and a cutter head and support frame adjuster selectively operable to shift the cutter head and support frame laterally relative to the fence and elevationally relative to the infeed plane.

17. A log turning machine as defined by claim 16, wherein the second ends of the guide members are spaced along the axis from the first ends by a distance at of between approximately 5 and 8 times the maximum diameter.

18. A log turning machine as defined by claim 16, further comprising a base frame movably supporting the support frame and wherein the cutter head and support frame adjuster includes a lateral adjuster that is selectively extendible and retractable and is mounted between the base frame and support frame such that extension and retraction of the lateral adjuster will cause the support frame to move laterally along the infeed plane with respect to the base frame.

19. A log turning machine as defined by claim 16, wherein the cutter head and support frame adjustor includes a lift that is operably mounted between the support frame and a primary support surface and that is selectively extendible and retractable such that extension and retraction of the lift will cause the support frame to move elevationally along the upright plane.

20. A log turning machine as defined by claim 16, further comprising a base frame movably supporting the support frame and wherein the cutter head and support frame adjustor includes a lateral adjuster that is selectively extendible and retractable and is mounted between the base frame and support frame such that extension and retraction of the lateral adjuster will cause the support frame to move laterally along the infeed plane with respect to the base frame; and wherein the cutter head and support frame adjustor further includes a lift that is mounted to between the base frame and a primary support surface and that is selectively extendible and retractable such that extension and retraction of the lift will cause the base frame and support frame to move elevationally along the upright plane.

21. A log turning machine, comprising:

a log conveyor defining a log infeed plane, configured to deliver an elongated log lengthwise along the log infeed plane and in a forward direction of travel;

an upright fence adjacent the log conveyor configured to tangentially engage and guide the elongated log lengthwise along the forward path of travel and along an upright plane intersecting the log infeed plane;

a support frame;

a base frame movably mounting the support frame;

a rotary cutter head mounted to the support frame and including a log receiving opening;

the rotary cutter head including internal cutters spaced angularly about the opening and spaced radially from the axis and configured to cut the elongated log to a prescribed diameter about the axis;

a set of elongated guide members having opposed first and second ends;

a first set of links mounting the guide members adjacent the first ends thereof to the support frame downstream with respect to the forward direction of travel from the internal cutters, for adjustable movement substantially radially with respect to the axis between a minimum and a maximum diameter and with the first ends adjacent the internal cutters;

a second set of links mounting selected guide members to the support frame adjacent the second guide member ends for adjustable movement substantially radially with respect to the axis;

wherein the guide members extend downstream with respect to the forward direction of travel by a distance approximately 7.3 times the maximum diameter;

a cutter head and support frame adjustor including a lateral adjuster that is selectively extendible and retractable and is mounted between the base frame and support frame such that extension and retraction of the lateral adjuster will cause the support frame to move laterally along the infeed plane with respect to the base frame; and wherein the cutter head and support frame adjustor further includes a lift that is mounted between the base frame and a primary support surface and that is selectively extendible and retractable such that extension and retraction of the lift will cause the base frame and support frame to move elevationally along the upright plane;

whereby the axis may be adjusted laterally and elevationally with respect to the infeed plane and upright plane independently of the infeed and upright planes such that the cutter head and guide members may be adjusted to cut logs to any selected diameter between the maximum and minimum diameters.

* * * * *

UNITED STATES PATENT AND TRADEMARK OFFICE

CERTIFICATE OF CORRECTION

PATENT NO : 6,039,094

DATED : March 21, 2000

INVENTOR(S) : Richard L. Neville

It is certified that error appears in the above-identified patent and that said Letters Patent is hereby corrected as shown below:

Col. 5, line 53
replace "(AA)"
with --( ▵ A)--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*